US009169643B2

(12) United States Patent
Dryburgh et al.

(10) Patent No.: US 9,169,643 B2
(45) Date of Patent: Oct. 27, 2015

(54) CONCRETE SLAB FORMING APPARATUS

(71) Applicants: Richard J. Dryburgh, Burlington (CA); Michael H. Maughan, Perkinsfield (CA); Graeme A. Bradley, London (CA)

(72) Inventors: Richard J. Dryburgh, Burlington (CA); Michael H. Maughan, Perkinsfield (CA); Graeme A. Bradley, London (CA)

( * ) Notice: Subject to any disclaimer, the term of this patent is extended or adjusted under 35 U.S.C. 154(b) by 0 days.

(21) Appl. No.: 13/986,244

(22) Filed: Apr. 16, 2013

(65) Prior Publication Data

US 2014/0306088 A1 Oct. 16, 2014

(51) Int. Cl.

| | |
|---|---|
| ***E04C 2/06*** | (2006.01) |
| ***E04C 2/38*** | (2006.01) |
| ***B22C 9/06*** | (2006.01) |
| ***E04C 2/04*** | (2006.01) |
| ***B28B 7/00*** | (2006.01) |
| *E04B 5/02* | (2006.01) |

(52) U.S. Cl.

CPC ..... *E04C 2/044* (2013.01); *B22C 9/064* (2013.01); *B28B 7/0014* (2013.01); *E04C 2/06* (2013.01); *E04C 2/384* (2013.01); *E04C 2/50* (2013.01)

(58) Field of Classification Search

CPC ..... E04C 2/044; E04C 2/06; E04C 2/384; E04C 2/50; E04B 5/02; E04B 5/04; E04B 2103/02; B28B 7/0014; B22C 9/06; B22C 9/064

USPC ..... 52/600, 601; 249/2, 3, 4, 5, 6, 7, 135, 249/139, 163, 164, 167

See application file for complete search history.

(56) References Cited

U.S. PATENT DOCUMENTS

| | | | | | |
|---|---|---|---|---|---|
| 917,859 | A | * | 4/1909 | Fusch | 52/489.1 |
| 925,204 | A | * | 6/1909 | Liljencrantz | 405/222 |
| 984,491 | A | * | 2/1911 | Richmond | 264/34 |
| 1,031,926 | A | * | 7/1912 | Hansbrough | 52/259 |
| 1,637,215 | A | * | 7/1927 | Coppock | 52/601 |
| 1,726,031 | A | * | 8/1929 | Lathrop | 52/601 |
| 1,953,203 | A | * | 4/1934 | Venzie | 52/583.1 |
| 2,000,110 | A | * | 5/1935 | Venzie | 52/483.1 |
| 2,128,375 | A | * | 8/1938 | Millard | 52/601 |
| 2,178,097 | A | * | 10/1939 | Davison et al. | 52/223.6 |
| 2,235,001 | A | * | 3/1941 | Allen | 264/69 |
| 2,338,246 | A | * | 1/1944 | Hoge | 52/601 |
| 2,372,038 | A | * | 3/1945 | Westveer | 52/410 |
| 2,423,695 | A | * | 7/1947 | Falco | 52/601 |
| 2,940,295 | A | * | 6/1960 | Post | 52/204.1 |
| 2,969,619 | A | * | 1/1961 | Didrick | 52/601 |
| 2,986,848 | A | * | 6/1961 | Greene | 52/396.05 |
| 3,394,523 | A | * | 7/1968 | Sackett, Sr. | 52/475.1 |
| 3,555,763 | A | * | 1/1971 | Bloxom | 52/745.11 |
| 3,609,935 | A | * | 10/1971 | Thomas | 52/745.11 |

(Continued)

FOREIGN PATENT DOCUMENTS

| | | | | |
|---|---|---|---|---|
| CA | 2481278 | * | 10/2003 | E04B 1/16 |
| CH | 470548 | * | 3/1969 | E04H 17/10 |

(Continued)

*Primary Examiner* — Michael Safavi

(74) *Attorney, Agent, or Firm* — Harness, Dickey & Pierce, P.L.C.

(57) ABSTRACT

A form for a concrete slab which consists of a series of similarly shaped steel plates that are held in predetermined spaced relationship by a series of special rebars, (special nuts are provided) before the slab is poured. The slab is criss-crossed by rebars which extend through the form to accurately locate the remaining steel plates as well as to prevent excessive cracking of the slab.

11 Claims, 5 Drawing Sheets

(56) References Cited

U.S. PATENT DOCUMENTS

| | | | | | |
|---|---|---|---|---|---|
| 3,611,533 | A | * | 10/1971 | Thomason | 29/897.34 |
| 3,621,624 | A | * | 11/1971 | Gustafson | 52/91.1 |
| 3,760,540 | A | * | 9/1973 | Latoria et al. | 52/125.5 |
| 3,774,359 | A | * | 11/1973 | Kahn | 52/125.4 |
| 4,575,984 | A | * | 3/1986 | Versteeg | 52/591.2 |
| 4,619,096 | A | | 10/1986 | Lancelot | 52/726 |
| 4,858,411 | A | * | 8/1989 | Graham | 52/601 |
| 5,152,118 | A | | 10/1992 | Lancelot | 52/726 |
| 5,491,948 | A | * | 2/1996 | Harris | 52/596 |
| 6,385,933 | B1 | * | 5/2002 | Owens | 52/404.5 |
| 6,494,008 | B1 | * | 12/2002 | Bloem et al. | 52/405.1 |
| 6,543,371 | B1 | * | 4/2003 | Gardner | 109/83 |
| 7,069,703 | B2 | | 7/2006 | Colefax et al. | 52/677 |
| 2002/0059768 | A1 | * | 5/2002 | Blount | 52/600 |
| 2004/0237437 | A1 | | 12/2004 | Hur | |

FOREIGN PATENT DOCUMENTS

| | | | | |
|---|---|---|---|---|
| DE | 2102121 | * | 12/1972 | E04B 2/72 |
| DE | 2264143 | * | 7/1974 | F16S 1/02 |
| FR | 1095395 | * | 11/1972 | E04C 2/06 |
| GB | 1298301 A | * | 11/1972 | E04B 2/04 |
| WO | WO 8801325 | * | 2/1988 | E04C 2/38 |

* cited by examiner

CONCRETE SLAB FORMING APPARATUS

BACKGROUND OF THE INVENTION

Concrete slabs have been manufactured over the past years using a variety of forms and materials. The Romans first used a slab composition composed of quick lime, pozzolana and a kind of pumice which is now known as Roman Concrete and this freed the Romans from the use of brick and stone in building structures. This substance was subjected to change and improvement until we have what is now known as modern concrete which is composed of Portland Cement (a powder) and a variety of aggregates to fill a variety of needs.

One question has always been with us, and that is "how do we increase the tensile strength of the cured concrete?" The present answer is the use of specially made steel rods (rebars) embedded in the concrete as it cured and this gives the necessary tensile strength to the cured concrete. It is known to use other materials such as fibres, steel shavings and materials such as horse hair which when added to the concrete mix improve its tensile strength.

Now that a satisfactory additive material has been found, what sort of a container (form) can be used hold the curing mixture as it sets? The form used by early practitioners and still is in use to day is wood. Here the pieces of wood are somehow joined to-gether at their ends to form an outer boundary which is supported by a system of stakes which are driven into the lower supporting surface (generally the earth) so as to maintain a desirable shape for the curing concrete. The lower surface which supports the concrete slab must be suitably prepared ahead of time. Uncured concrete is heavy and it is not unusual to have additional stakes driven into the supporting media beneath the concrete slab at angles which are required to buttress the form in areas where it is misshapen and bent out of the desired shape so that it requires additional support. The concrete is held in this form until sufficient time has elapsed that it is cured sufficiently to allow the removal of the wooden forms.

This invention seeks to provide a form that is much easier to use, in that it is easier to set up, and yet does not impede the curing process of the concrete. It will be found that this form is easy to assemble by unskilled labour which contributes to its overall efficiency. Because this invention utilizes a metal form, means are incorporated for accurately locating the members composing this form.

SUMMARY OF THE INVENTION

This invention uses a permanent steel form which is held in the desired shape by the stiffness of the steel forms, which when coupled with the special threaded reinforcing bars (rebars) which extend across the form (in both directions) and through holes provided in the sheet steel forms (end plates and side plates) to hold the form sections of the form secure. Of course special nuts are threaded on to the ends of the threaded rebars. To help keep the cost of the form to a low value, unthreaded rebars are interspersed at intervals between the threaded rebars. It is understood however, that these unthreaded bars may or may not pass through apertures in the steel plates which are used to surround the concrete slab. In any event, these unthreaded rebars contribute nothing to the location of the steel plates surrounding the concrete slab.

BRIEF DESCRIPTION OF THE DRAWINGS

In order to better understand the invention, a concrete slab of predetermined dimension is illustrated herein, it being understood that the dimensions of the slab have been clearly defined by the Supervising Authority beforehand.

DESCRIPTION OF THE PREFERRED EMBODIMENT OF THIS INVENTION

In order to successfully design the slab of this invention it will be found that several of the values that are used in association with this invention have been predetermined beforehand. For instance the thickness of the slab normally will be specified by the designer of the slab. In no event will the thickness of the slab be less than four inches and greater than eight inches. Generally the thickness will be dictated by the National Building Code and/or by the Building Code in the area in which the slab is to be located.

The concrete form generally uses a steel form that has a vertical height of about six inches. This is a matter for the Designer of the form to decide. As soon as the Designer has determined the thickness of the Concrete Slab will be, he is ready to specify the vertical height of the steel framework. which will surround the concrete slab.

Any adjustment to the thickness is done using a foamed styro-foamed material known as "SM" which may be placed inside the steel form when it is decided to lesson the thickness of the concrete slab, or it is put under the steel form when it is decided that the concrete slab should be thicker than what was the thickness as originally projected.

Similarly the length and width of the slab will be set out in the specifications for the concrete slab. This helps the design process immensely. This invention uses the same (of the same dimension) shaped steel members for both the side plates and the end plates (to keep the costs down) of the designed form.

Figure 1:
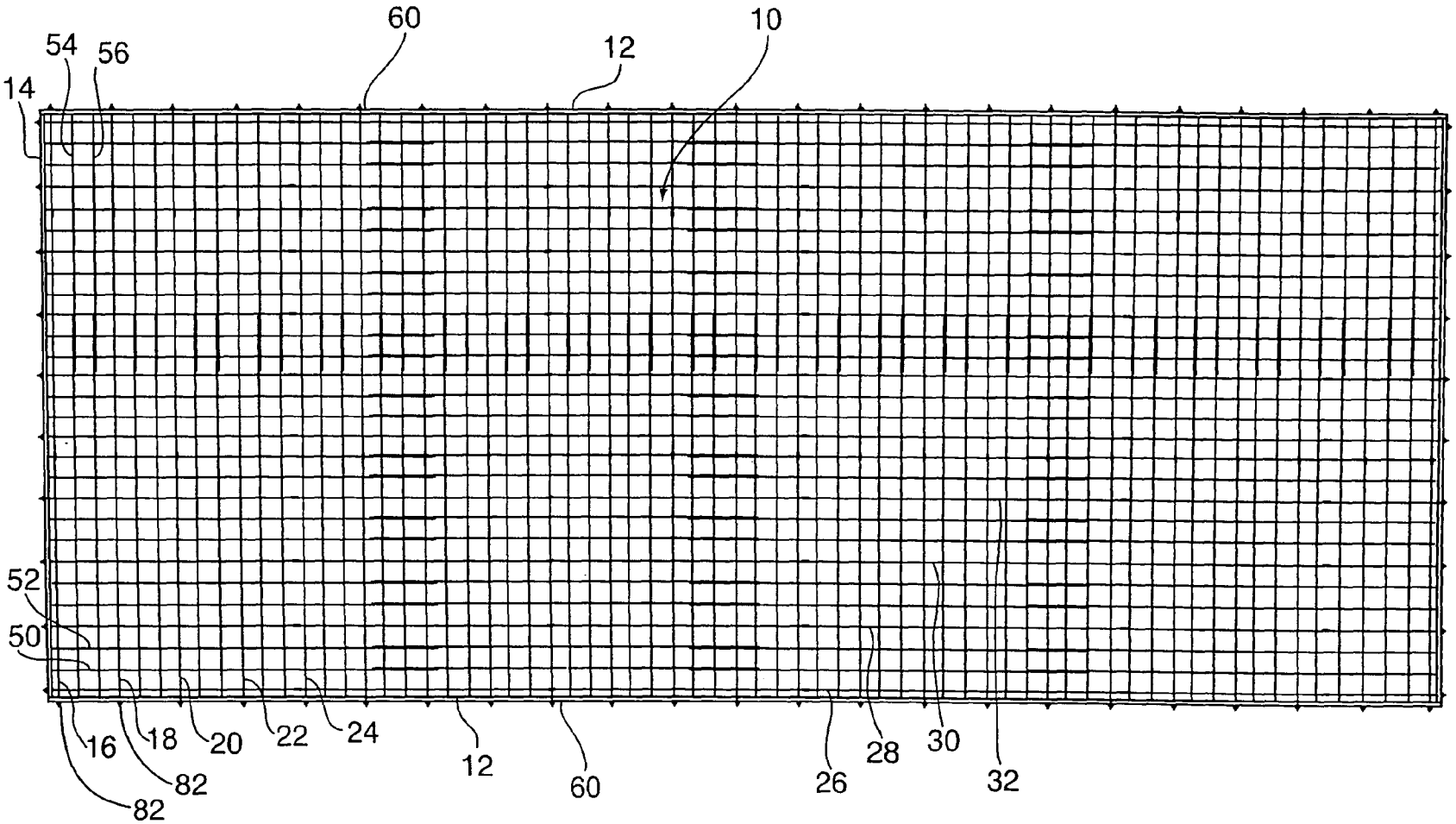
FIG. 1 is a plan view of the form and the concrete slab that has been manufactured according to this invention.

Referring now to FIG. 1 a slab 10 which is manufactured in accordance with this invention is shown in plan. Slab 10 may be of any size but is shown here to be of a size one hundred feet by forty feet and is six inches in thickness. These dimensions are frozen at the time of the design of the concrete slab 10. The concrete slab 10 is totally enclosed by steel side plates 12 and steel end plates 14. The side plates 12 and end plates 14 are held in place (typically) by threaded reinforcing rods (rebars) 16 and 18, which completely pass through the slab 10 and pass through holes provided in the side plates 12 and the end plates 14. Nuts 82 (a special shape) are threaded onto the protruding ends of the rebars 16 and 18. It will be seen that rebars 16 and 18 are separated by a pair of rebars (having unthreaded ends) 54 and 56. Rebars 26 and 28 will be separated by rebars 50 and 52 (standard rebars), and rebars 26 and 28 will serve to accurately locate the steel side plates 12 and end plates 14.

Figure 2:
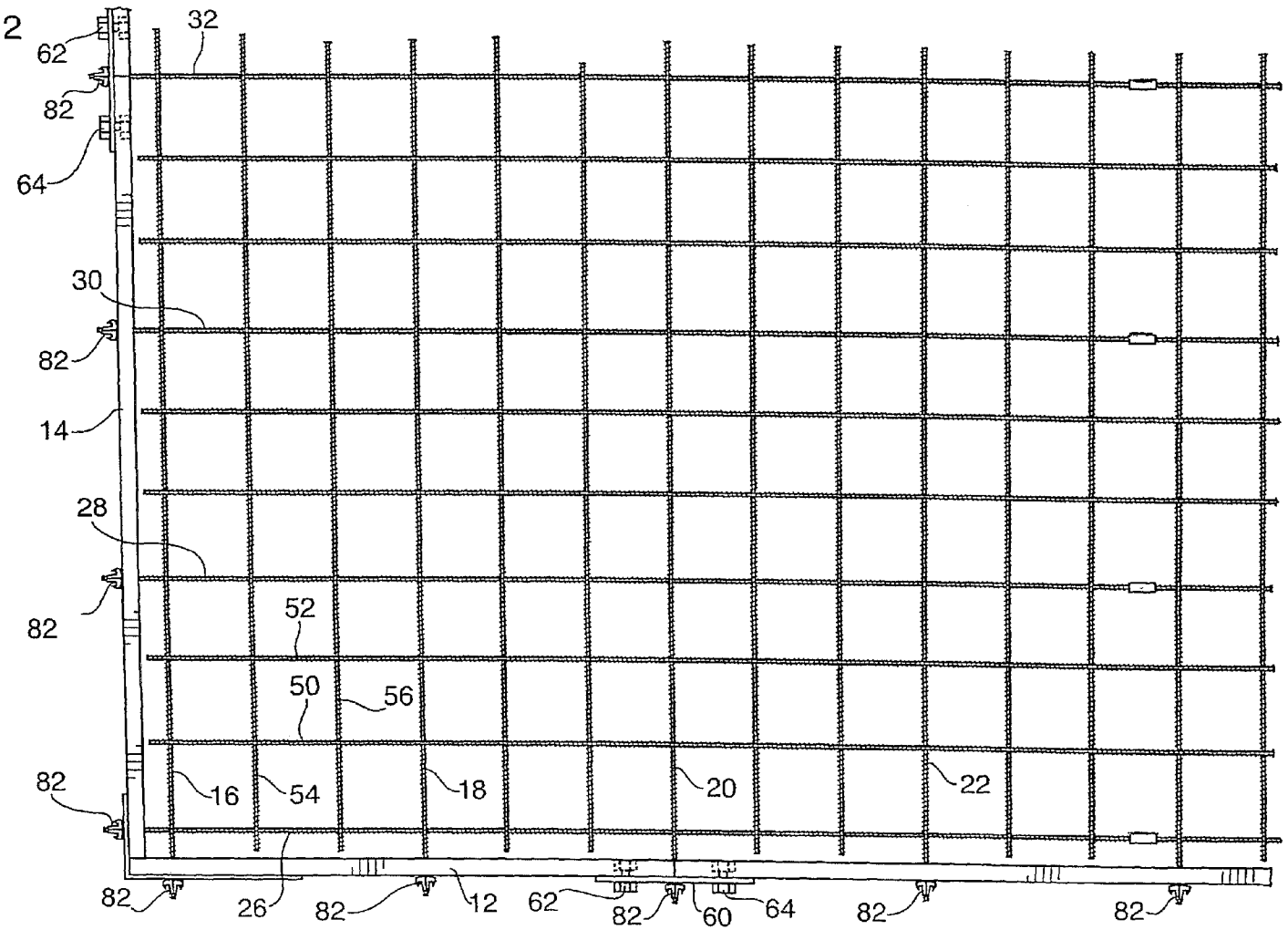
FIG. 2 is an amplification of a part of FIG. 1 and is a sectional perspective drawing of this invention.

FIG. 2 shows a section of FIG. 1 in order to better illustrate the construction of the forms surrounding the slab 10. Because the concrete slab is weak in tensile strength it will be found convenient to locate at least two standard reinforcing bars between the specially threaded rebars. Thus bars 54 and 56 (these rebars will be unthreaded) are located between each threaded rebar 16 and 18 to prevent excessive cracking of the concrete slab. Bars such as 54 and 56 may be located at somewhat evenly spaced intervals between the threaded rods 16 or 18. It is understood that no locating forces of the steel side plates 12 or steel end plates 14 is provided by the standard rebars such as 54 and 56.

Figure 3:
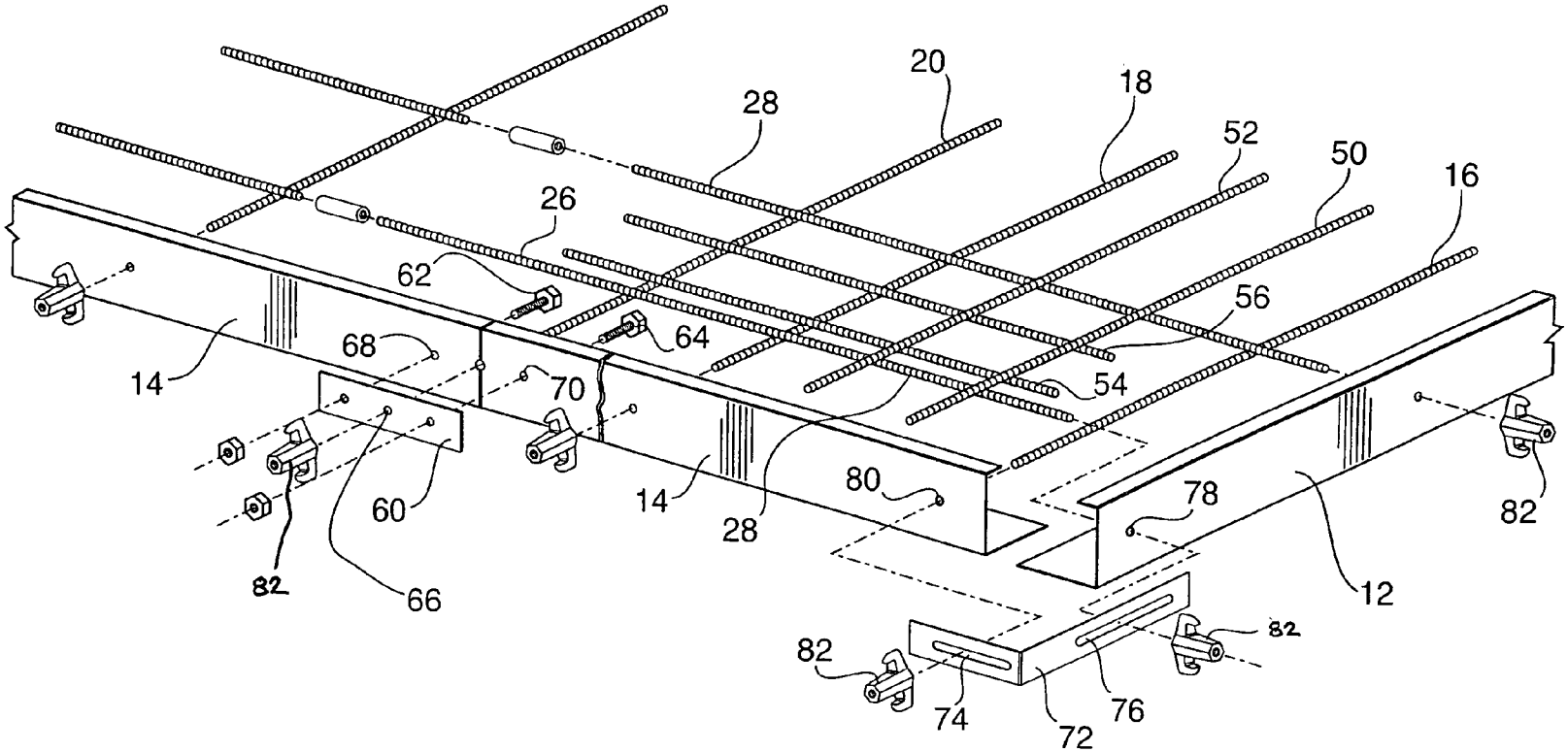
FIG. 3 shows a an exploded view of the drawing of a corner of the form of this invention.

Referring now to FIG. 3 (an exploded view of a corner of the mold) a section of side plate 12 and end plate 14 is shown having threaded rebar rods passing there through the holes 78 and 80 provided therein. Threaded rebar 16 is shown having special nut 82 threaded thereon. Here the slab 10 is not shown and the standard rebar 54 is shown spaced at some predetermined distance away from threaded rebar 26. Another standard rebar 56 will be located a second predetermined distance from the first standard rebar 54. In order that rebars 54 and 56 extend the total distance through the slab, they must usually be joined or connected along their length in the concrete slab in some manner. The rebars 54 and 56 are usually shipped in containers which house many other building components. Thus the maximum length of the rebar is governed by the maximum length of the shipping container. When the distance to be traversed by each of the standard rebars exceeds the length of rebar available, each rebar such as bar 54 must be spliced. It has been found that an overlap of eighteen inches at the joint interface is sufficient, however the National Building Code and/or the Building Code of the area will be the controlling factor.

Each corner of the form will be provided with a splice piece shown as corner piece 72. Corner pieces 72 are provided with slots 74 and 76 for simple and easy adjustment. The corner piece splice plates, such as splice plates 72 are physically located by the passage of the threaded rebars through the holes such as 80 in the side plate 14 and holes such as 78 in end plate 12. Thus rebar 16 locates the position of side plate 14 (by passage through hole 80) and thence through slot 74 of the corner splice piece 72. Nut 82 is threaded on to rebar 16 to secure the position of end plate 14. Similarly the passage of threaded rebar 26 through holes such as 78 in end plate 12 and then through slots such as 76 in corner splice plate 72 serve to hold the corner of the form firmly in place.

The splice plates 60 for the side plates such as 12 and end plates such as 14 are attached to the form a little differently than the corner splice plates 72. Here the splice plates such as the splice plate 60 have a central hole 66 provided for the passage of threaded rebar (such as threaded rebar 20). This physically locates the side members of the form. Splice plates 60 are attached to the side plates 12 and end plates 14 by means of a pair of bolts such as those shown as 62 and 64 which pass through a pair of previously drilled holes 68 and 70 in steel side plates 14. This assures the proper spacing of the form members joined together by such a splice plate 60.

Figure 4:
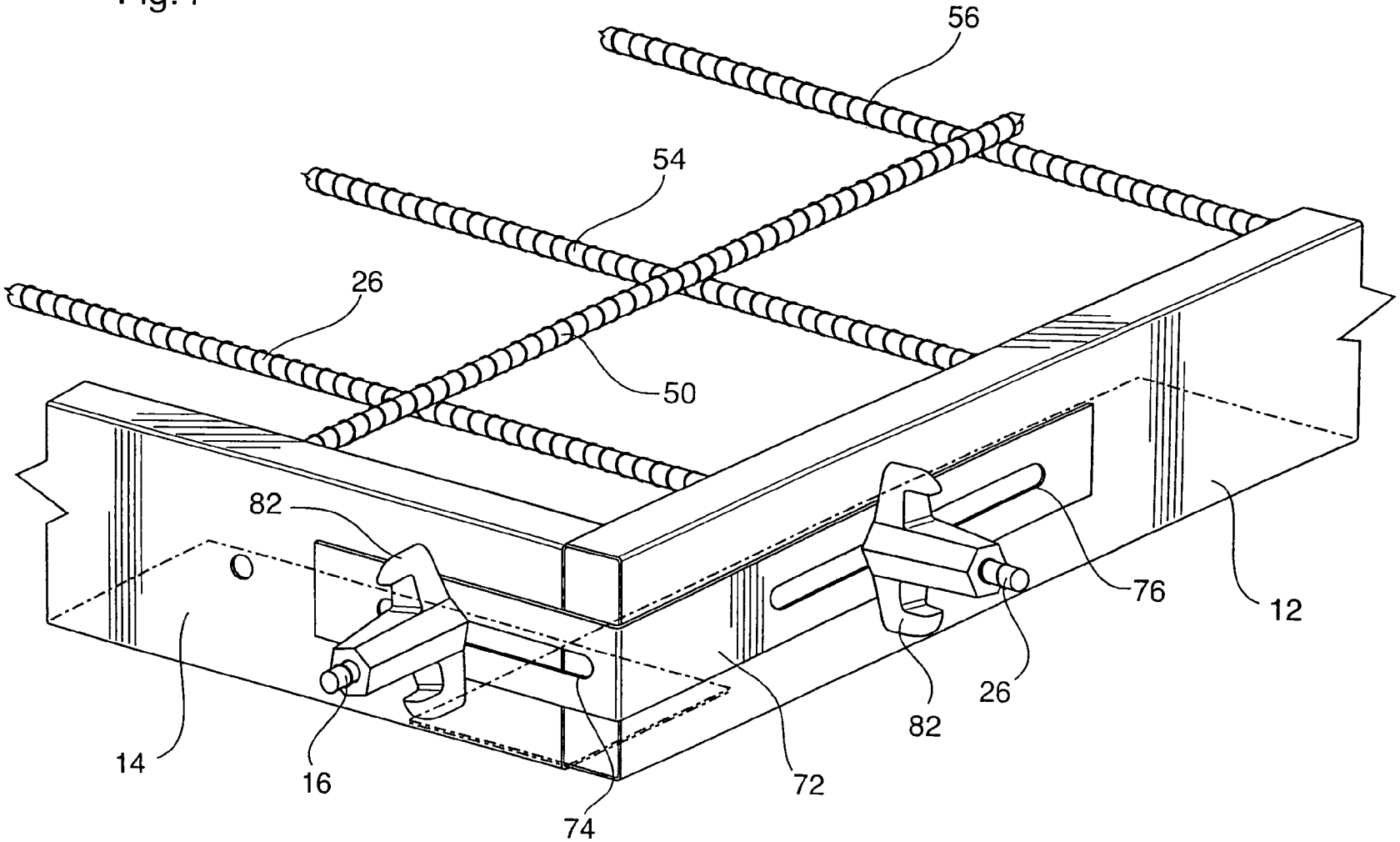
FIG. 4 is a perspective drawing of the construction of a finished corner of the form of this invention.

FIG. 4 is an enlargement of the assembled corner of FIG. 3. Here rebar 26 is shown having special nut 82 attached thereto. Similarly, rebar 16 is shown with special nut 82 attached thereto. This Figure shows how the corner of the form is physically located and assembled.

Figure 5:
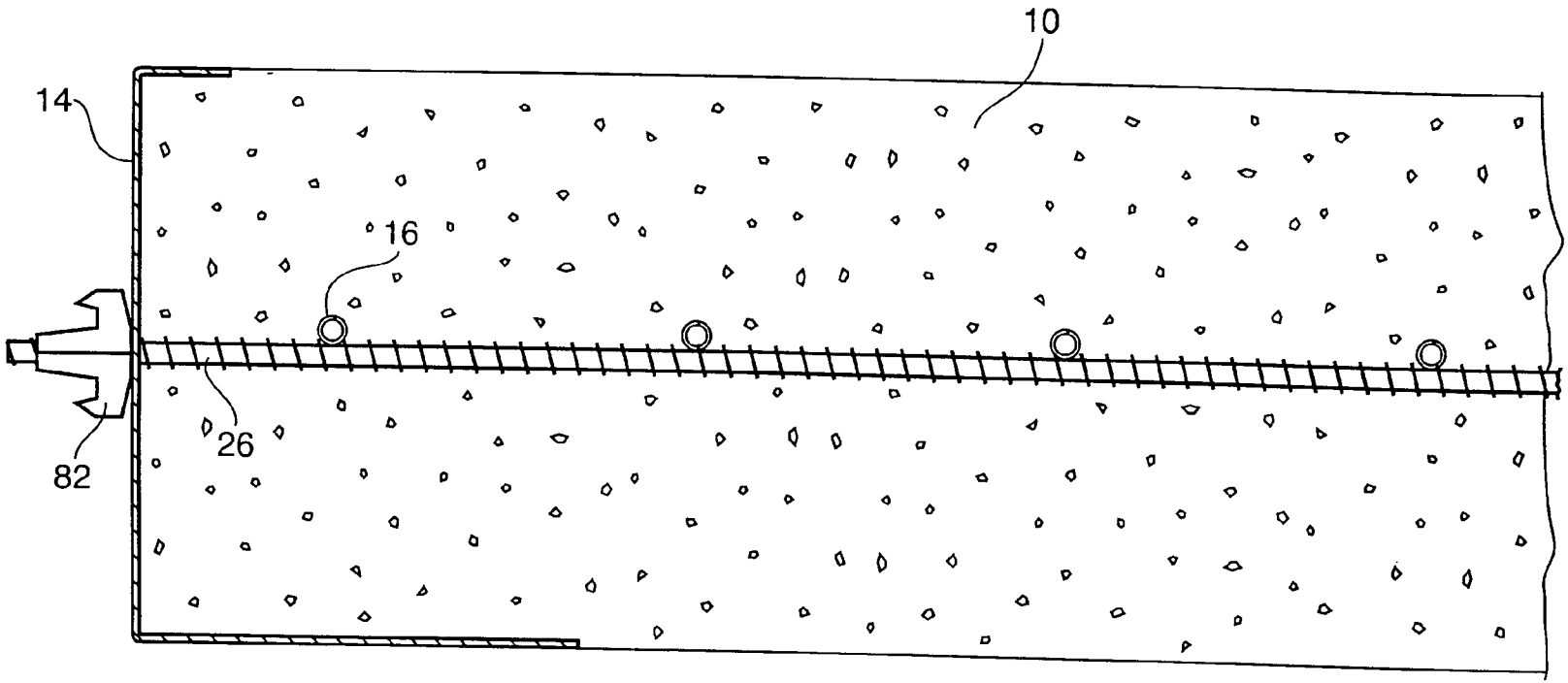
FIG. 5 is an elevational sectional view of a portion of a finished slab of concrete made in accordance this invention.

FIG. 5 shows an elevational sectional view of the concrete slab 10 with the side plates 14 in place. The positioning of rods 16 and 26 in the finished product is to be noted.

This form was specifically designed to be assembled quickly (and adjusted quickly) where unskilled labour is the only source of labour available. No expensive trenches need to be dug around the outside of the form; the slab simply floats on the reference medium. The form will be found to be exceptionally useful in far away locations in third world countries where only local help will be provided will be unskilled labour. Because the slab will always be weak in tensile strength the addition of the steel rebar to this invention merely serves to increase the strength of the resulting product.

Many modifications and other embodiments of the invention will come to mind of one skilled in the art, having the benefit of the teachings presented in the foregoing description and the associated drawings. Therefore, it is to be understood that the invention is not to be limited to the specific embodiments Therefore, it is to be disclosed, and that the modifications and embodiments are intended to be included within the scope of the dependent claims.

The invention claimed is:

1. A concrete slab forming assembly comprising:

a first side plate;

a second side plate extending parallel to the first side plate;

a first end plate extending perpendicular to each of the first side plate and the second side plate;

a second end plate extending parallel to the first end plate and extending perpendicular to each of the first side plate and the second side plate;

a plurality of first longitudinally extending rebars coupled at opposite ends thereof to the first side plate and the second side plate;

a plurality of second longitudinally extending rebars extending parallel to the plurality of first longitudinally extending rebars, each one of the plurality of second longitudinally extending rebars terminating prior to reaching the first side plate and the second side plate, wherein at least one of the plurality of second longitudinally extending rebars is between two neighboring ones of the plurality of first longitudinally extending rebars;

a plurality of first laterally extending rebars coupled at opposite ends thereof to the first end plate and the second end plate;

a plurality of second laterally extending rebars extending parallel to the plurality of first laterally extending rebars, each one of the plurality of second laterally extending rebars terminating prior to reaching the first end plate and the second end plate, wherein at least one of the plurality of second laterally extending rebars is between two neighboring ones of the plurality of first laterally extending rebars;

wherein each one of the first side plate, the second side plate, the first end plate, and the second end plate are made of steel.

2. The concrete slab forming assembly of claim 1, wherein only two of the plurality of second longitudinally extending rebars are between two neighboring ones of the plurality of first longitudinally extending rebars; and wherein only two of the plurality of second laterally extending rebars are between two neighboring ones of the plurality of first laterally extending rebars.

3. A form for a concrete slab comprising:

a set of steel members which are of similar shape joined together to surround and contain said slab on a reference surface;

a first set of specially shaped reinforcement rods (rebars) having a threaded surface;

said first set of rebars passing though said slab and though apertures provided in said steel members, so that special matching nuts may be threaded onto the protruding ends of said first set of rebars to physically accurately locate said steel members comprising the form;

a second set of standard rebars spaced from said first set of rebars by a predetermined distance, said second set of rebars pass through said slab only and do not locate the steel members, the second set of standard rebars terminate prior to reaching the steel members; and said second set of rebars being maintained at a specific distance above said reference surface;

wherein at least one of said first set of rebars extend longitudinally and at least one of said first set of rebars extend laterally; and wherein at least one of said second set of rebars extend longitudinally and at least one of said second set of rebars extend laterally.

4. A form for a concrete slab as claimed in claim 3 in which said steel members forming the enclosure are not removed when said concrete slab is cured.

5. A form for a concrete slab as claimed in claim 4 in which corners of said form are formed by said steel plates having the same shape as the steel plates forming the enclosure.

6. A form for a concrete slab as claimed in claim 5 in which said corners are formed by the suitable abutment of two steel corner plates located by having at least two bars of said longitudinally extending first set of rebars pass through matching apertures provided in said steel plate forming said corner for said enclosure and wherein at least two bars of said laterally extending first set of rebars pass through and locate the oteher of the steel plates forming said corner and nuts are secured to the protruding ends of said two rebars of the second set.

7. A form for a concrete slab as claimed in claim 5 in which said corners each have a reinforcing splice piece applied to said steel plates forming said corner, each of said corner splice pieces having at least two elongated apertures provided at predetermined locations therein for reception of the end of at least one of said longitudinally extending first set of said steel rebars to pass through said steel reinforcing plate forming said corner and at least one of the steel rebars of said laterally extending first set of said steel rebars passes through the second aperture provided in said splice piece and the steel plate forming the corner.

8. A form for a concrete slab as claimed in claim 5 in which said corner splice reinforcing piece is a suitable steel strap bent to form a right angle.

9. A form for a concrete slab as claimed in claim 8 in which said corner reinforcing splice piece is a steel strip of suitable thickness having two legs, each leg having an elongated aperture formed in it.

10. A form for a concrete slab as claimed in claim 3 in which said members are joined together along their length at predetermined junctions by the application of suitable splice plates, said splice plates being located on the outside of said steel members forming said enclosure for said slab and said splice plates having a centrally located aperture formed therein, a rebar from said first set of rebars passing through said aperture formed in said steel members forming said junction, said splice plates having attachment means for attachment to said steel members forming said junction.

11. A form for a concrete slab as claimed in claim 3 in which said first set of rebars are joined together by suitable elongated nuts at their ends.

* * * * *